United States Patent [19]

Hirose et al.

[11] Patent Number: 4,861,324

[45] Date of Patent: Aug. 29, 1989

[54] APPARATUS FOR MANUFACTURING TOBACCO FILTER

[75] Inventors: Ichiro Hirose; Shichisei Tani; Motonori Inamura; Takashi Koyama, all of Hiratsuka, Japan

[73] Assignee: Japan Tobacco Inc., Tokyo, Japan

[21] Appl. No.: 69,511

[22] Filed: Jun. 8, 1987

Related U.S. Application Data

[63] Continuation-in-part of Ser. No. 831,336, Feb. 20, 1986, abandoned.

[30] Foreign Application Priority Data

Apr. 11, 1985 [JP] Japan ..... 60-075397
May 22, 1987 [JP] Japan ..... 62-123674

[51] Int. Cl.[4] ..... B31C 13/00
[52] U.S. Cl. ..... 493/48; 493/74
[58] Field of Search ..... 493/45, 47, 48, 50; 222/217, 224, 368; 131/344

[56] References Cited

U.S. PATENT DOCUMENTS 3,405,717 10/1968 Berger et al. ..... 493/47
3,844,200 10/1974 Sexstone .
3,910,166 10/1975 Sexstone .
4,016,830 4/1977 Sexstone .
4,214,508 7/1980 Washington .
4,742,699 5/1988 Nakahara et al. ..... 118/50

FOREIGN PATENT DOCUMENTS 0014477 8/1980 European Pat. Off. .

*Primary Examiner*—Robert P. Olszewski
*Assistant Examiner*—Robert Showalter
*Attorney, Agent, or Firm*—Nixon & Vanderhye

[57] ABSTRACT

A tobacco filter manufacturing apparatus for making filter rods added with additives therein. A length of filter material is held between a conveyor system and a mask ring to be fed into a predetermined direction. The conveyor has laterally extending air permeable sections and air non-permeable sections; the mask ring has laterally extending slits and mask sections between the slits. The air permeable sections of the conveyor and slits in the mask ring are set in registry with each other. The conveyor and mask ring are synchronously driven. Within the mask ring is provided an additive supplier while the conveyor is provided with a negative pressure source such that the additive is adsorbed through the slits onto the filter material under the negative pressure behind the filter material through the air permeable sections of the conveyor.

7 Claims, 6 Drawing Sheets

APPARATUS FOR MANUFACTURING TOBACCO FILTER

This is a continuation-in-part application of U.S. Pat. application Ser. No. 831,336 filed Feb. 20, 1988 now abandoned.

BACKGROUND OF THE INVENTION

The present invention relates to an apparatus for manufacturing a cigarette filter and more particularly to an apparatus for manufacturing a tobacco filter with a granular additive added into the filter.

Various granular additives have heretofore been added into tobacco filters for improving the adsorbability and absorbability of the filters. Usually such additives are each added into a certain portion in a filter material so as to be enclosed with the filter material, or a filter material is divided into two filter halves and a granular additive is added so as to be held between those filter halves.

Of the above two kinds of tobacco filters, in the former there is the possibility that during transport or smoking the additive added into the fiter material will move and be exposed to a smoking end of the tobacco filter and get into the smoker's mouth. In the former, moreover, since the additive is concentrated on one part of the filter material, it is impossible to ensure a large area of contact of the additive with the tobacco smoke passing through the filter material and consequently the adsorbing and absorbing properties of the additives are impaired.

On the other hand, in the latter case, its structure wherein the additives is held between the two filter halves, is effective for preventing the movement of the additive, but is disadvantageous in that the tobacco filter manufacturing process becomes complicated, resulting in increased cost. In the latter case, moreover, it is impossible like the former case to ensure a large area of contact of the additive with the tobacco smoke passing through the filter material with the result that the adsorbing and absorbing properties of the additive are impaired.

SUMMARY OF THE INVENTION

The present invention has been accomplished in view of the circumstances mentioned above and it is the object thereof to provide a tobacco filter manufacturing apparatus which can manufacture tobacco filters easily and which can improve the adsorbing and absorbing properties of additives.

The present invention provides a tobacco filter manufacturing apparatus comprising air permeable conveyor means for conveying a length of belt-like tobacco filter material longitudinally in a predetermined direction; a mask member disposed in facing relation to said air permeable conveyor means to hold and length of belt-like tobacco filter material therebetween, said mask member having a plurality of slits therein extending laterally with respect to said length of filter material, and a plurality of mask sections between said slits, said air permeable conveyor means having air permeable sections and air non-permeable sections extending laterally and alternately, and extending from at least immediately downstream of said mask member, said air permeable sections of the conveyor means being set in registry with said slits in the mask member, said air non-permeable sections of the conveyor means being set in registry with said mask sections of the mask member, said mask member being adapted for synchronized travel together with said air permeable conveyor means in said predetermined direction; suction means provided on a remote side of the air permeable conveyor means from the filter material; and means for supplying granular additive into said slits such that said granular additive adheres onto the tobacco filter material in laterally extending separate areas thereof through said slits due to suction from said suction means.

BRIEF DESCRIPTION OF THE DRAWINGS

FIGS. 1 to 9 illustrate an embodiment of the present invention, of which;

FIG. 1 is a sectional view of an additive distributing and feeding device;

FIG. 2 is a schematic view of the whole of a tobacco filter manufacturing apparatus;

FIG. 3 is a sectional view taken along like III-III in FIG. 1;

FIG. 4 is a side view of an additive feeder, partly broken away;

FIG. 5 is a sectional view taken along line V—V in FIG. 4;

FIG. 6 is a top view of a filter material with an additive adhered thereto;

FIG. 7 is a sectional view of FIG. 6;

FIG. 8 is a transverse sectional view of a tobacco filter manufactured; and FIG. 9 is a longitudinal sectional view of FIG. 8.

FIGS. 10 and 11 illustrate modifications of the present invention, of which:

FIG. 10 is a sectional view of a part of a mask ring;

FIG. 11 is a sectional view of an additive distributing and feeding device;

DESCRIPTION OF PREFERRED EMBODIMENTS

An embodiment of the present invention will be described hereinunder with reference to FIGS. 1 to 9.

Figure 2:
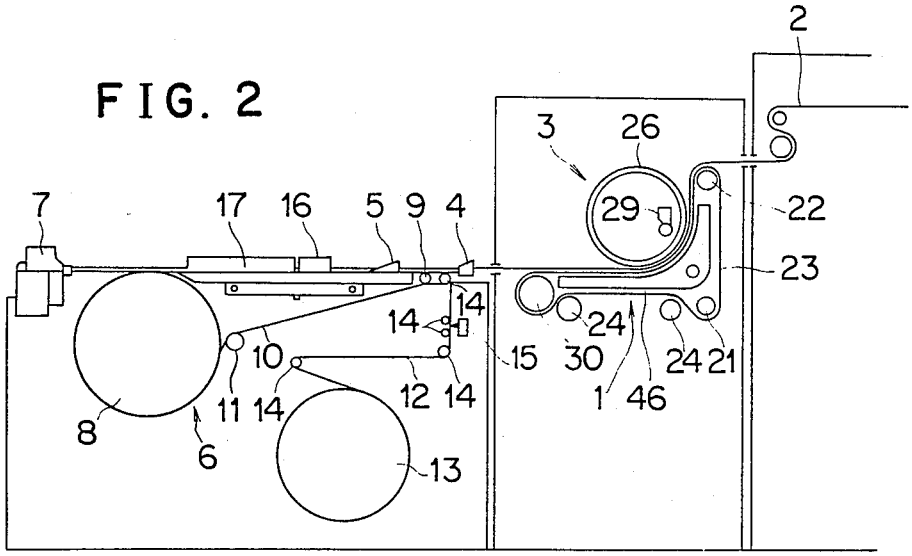

A brief explanation will first be made about the entirety of a tobacco filter manufacturing apparatus which is illustrated in FIG. 2. The reference numeral 1 in FIG. 2 denotes a first conveyance mechanism for conveying length of a belt-like filter material 2 to the left in the figure. The filter material 2 is formed from a fibrous cellulose acetate. But the material is not limited thereto. It may be formed from paper, woolen yarns or a fibrous rough hemp. Disposed above the filter material 2 is an additive distributing and feeding device 3 which supplies an additive at predetermined intervals in a moving direction of the filter material 2. Ahead of the additive distributing and feeding device 3 in the moving direction of the filter material are disposed first and second forming devices 4 and 5 for forming the belt-like filter material 2. The first and second forming devices 4 and 5 are both tubular members which are in the shape of a funnel. The belt-like filter material 2 is formed in to a round rod while passing through the first and second molding devices 4 and 5.

Ahead of the first and second forming devices 4 and 5 in the moving direction of the filter material is disposed a second conveyance mechanism 6 for conveying the filter material 2 thus formed into a round rod toward a cutter 7 which is positioned in front of the conveyance mechanism 6. For example, the second conveyance mechanism 6 is constituted by an endless conveyor belt 10 stretched between a driving roller 8 of a large diameter and a driven roller 9 of a small diamter. The numeral 11 in FIG. 2 denotes a tension roller which imparts a predetermined tension to the conveyor belt 10.

Between the second conveyance mechanism 6 and the additive distributing and feeding device 3 is disposed a wrapping paper roller 13 with a filter material wrapping paper 12 wound thereon. The wrapping paper 12 delivered from the roller 13 is conducted into the second forming device 5 through a roller 14, whereby it is wound round the outer peripheral surface of the filter material 2 which has been formed into a round rod by the first forming device 4. Further, a paster 15 is disposed midway of the conveyance path of the wrapping paper 12 extending to the second forming device 5. The paster 15 pastes one face of the wrapping paper 12, whereby the wrapping paper 12 is securely wound and pasted onto the outer peripheral surface of the filter material 2. The round rod-like filter material 2 thus wrapped in the wrapping paper 12 is conveyed to the cutter 7 through a heater 16 and a cooler 17 by means of the second conveyance mechanism 6 as previously noted and is cut into a predetermined size by the cutter 7.

Mechanisms and devices located after the additive distributing and feeding device 3 are of the same structures as in the prior art and may be modified in practicing the present invention.

The first conveyance mechanism 1 and the additive distributing and feeding device 3 according to the present invention will be explained below with reference to FIGS. 1 to 5.

Figure 1:
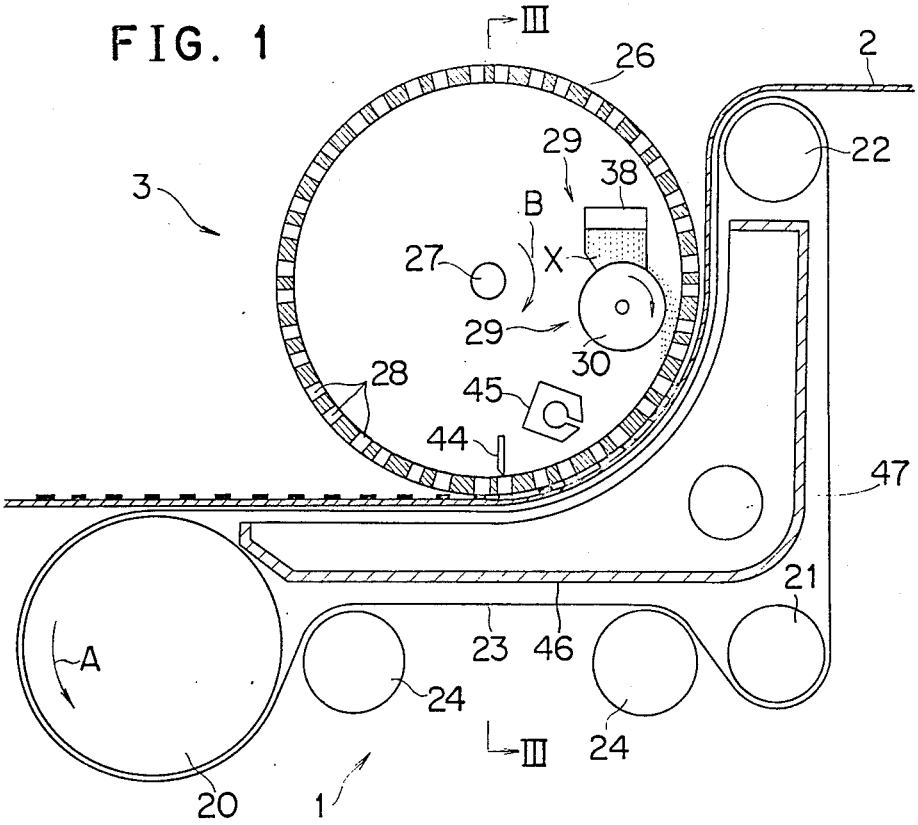

The first conveyance mechanism 1 is composed of a driving roller 20 of a large diameter, driven rollers 21 and 22 of a small diameter, and a porous conveyor belt 23 stretched over the rollers 20, 21 and 22 for conveying the filter material 2. The conveyor belt 23 is a porous belt through not shown, which permits a free permeation of air. The numeral 24 in FIG. 1 represent guide rollers for guiding the movement of the conveyor belt 23. The driving roller 20, driven rollers 21, 22 and guide rollers 24 are rotatably supported by a frame 25 shown in FIG. 3. The driving roller 20 is rotated in the direction of arrow A in FIG. 1 by means of a drive source (not shown) which is synchronized with the second conveyance mechanism 6.

The additive distributing and feeding device 3 disposed above the first conveyance mechanism 1 is provided with a mask ring 26. The mask ring 26 is constituted by a hollow flat cylinder whose one side face is open. To a central part of a closed face of the mask ring 26 is connected a rotating shaft 27 which is connected to a drive source (not shown) synchronized with the second conveyance mechanism 6.

Figure 3:
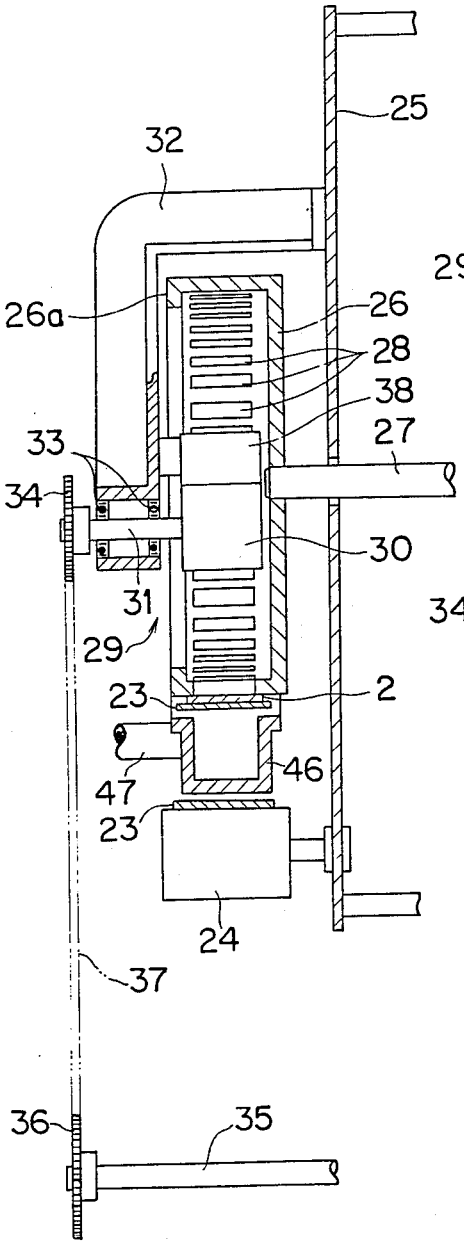
Figure 4:
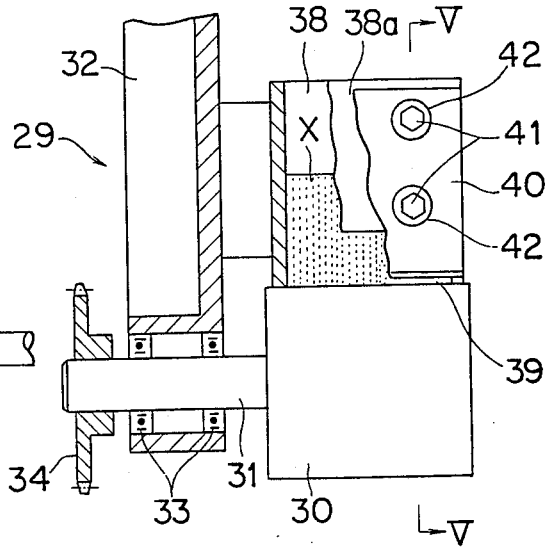

In the outer peripheral surface of the mask ring 26 are formed a number of laterally extending slits 28 at equal intervals in a circumferential direction as shown in FIGS. 1 and 3. The slits 28 are each of an elongated shape extending axially of the mask ring 26 and two neighboring slits, in cross section, are spaced apart from each other in an inner surface of the annular structure. Further, a rim 26*a* is formed in the open side of the mask ring 26 to project radially inwardly from the periphery thereof.

The outer peripheral surface of the mask ring 26 is in contact with the conveyor belt 23 through the filter material 2 which is conveyed by the first conveyance mechanism 1, as shown in FIG. 1. As a result, the upper surface of the filter material 2 is partitioned into first areas in which it is exposed to the exterior through the slits 28 and second areas in which it is covered from the exterior. The first and second areas are defined alternately in the moving direction of the filter material. As the mask ring 26 of annular structure comes into rolling contact with the conveyor belt 23 of the first conveyance mechanism 1 through the filter material 2, a predetermined tension is imparted to the belt 23. In FIG. 1, however, for convenience of drawing the figure, the outer peripheral surface of the mask ring 26 and the filter material 2 and conveyor belt 23 are shown in spaced relation to each other.

The mask ring 26 is rotated in the direction of arrow B in FIG. 1 and its peripheral speed is set at the same speed as the travelling speed of the conveyor belt 23, whereby a smooth conveyance of the filter material 2 can be ensured and the first and second areas can be defined continuously on the upper surface of the filter material 2. The rotating speed of the mask ring 26 is set so that the slits 28 and the cutter 7 are synchronized with each other.

Within the mask ring 26 is disposed an additive feeder 29 on an upstream side of the rotating shaft 27. As shown in detail in FIGS. 3 to 5, the additive feeder 29 is provided with a metallic feed roller 30 which is disposed near the inner peripheral surface of the mask ring 26. The feed roller 30 has a roller shaft 31 which is supported at a free end or lower end of a support arm 32 rotatably through bearings 33. An upper end of the support arm 32 extends upward over the outer periphery of the mask ring 26 and is fixed to the frame 25.

A sprocket 34 is attached to a fore end of the roller shaft 31 and a chain 37 is stretched between the sprocket 34 and a sprocket 36 which is attached to a fore end of a drive shaft 35. The drive shaft 35 extends in parallel with the rotating shaft 27 of the mask ring 26 and is rotated synchronously by the same drive source as that for the mask ring.

Above the feed roller 30 is disposed an additive feed hopper 38. The hopper 38 is in the form of a box having upper and lower opens ends, the lower end opening being closed with the feed roller 30. In the feed hopper 38 is stored an additive X such as granular active carbon, silica gel or ion exchange resin. A hopper opening 39 is formed in an end face 38*a* on a downstream side of the feed roller 30 with respect to the rotation thereof. The degree of opening of the hopper opening 39 can be adjusted by an adjusting plate 40 which is attached to the end face 38 *a* of the feed hopper 38 with adjusting bolts 41 and washers 42. In the adjusting plate 40 are formed bolt insertion holes 43 by vertically extending slots, whereby a vertical position of the adjusting plate 40, namely, the degree of opening of the hopper opening 39, can be adjusted.

Moreover, within the mask ring 26 is disposed a scraper 44 which is positioned just under the rotating shaft 27 and which is in contact with the inner peripherial surface of the mask ring 26, and also disposed is an air nozzle 45 which is positioned closer to the additive feeder 29 than the scraper 44. The air nozzle 45 can eject a compressed air toward the inner peripheral surface of the mask ring 26. The scrapper 44 and the air nozzle 45 are supported by support means (not shown) from the open end side of the mask ring 26.

Further, in the area of the first conveyance mechanism 1 surrounded with the conveyor belt 23 is disposed an air suction member 46 whose side facing the conveyor belt 23 is open along the same belt. The air suction member 46 is connected to a vacuum pump (not shown) through a suction pipe 47.

The operation of the additive distributing and feeding device 3 constructed as above will be explained below.

Figure 5:
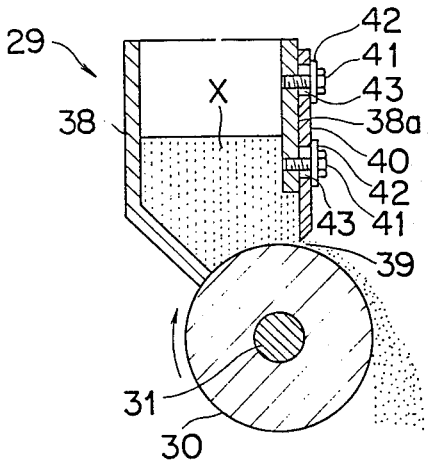
Figure 6:
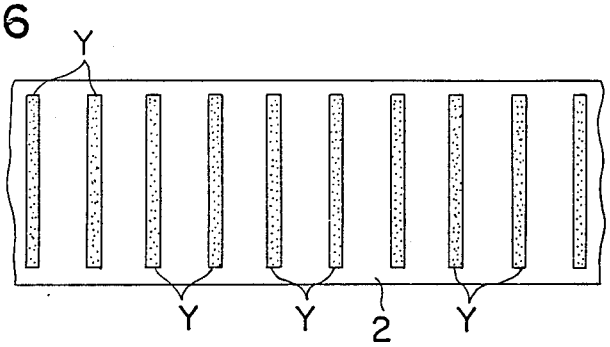
Figure 7:
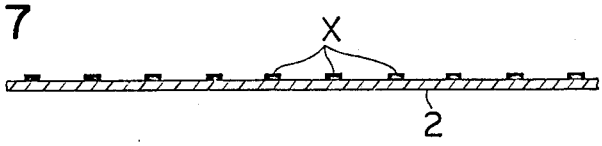

When the filter material 2 is conveyed by the first conveyance mechanism 1 and reaches the position of the mask ring 26, its upper surface is partitioned into the first area in which it is exposed to the exterior through the slits 28 and the second areas in which it is covered with the outer peripheral surface of the mask ring 26, alternately in the moving direction of the filter material. If the feed roller 30 of the additive feeder 29 is rotated in this state, the additive X is fed to the exterior from the hopper opening 39 of the feed hopper 38 with rotation of the feed roller 30, as shown in FIG. 5. The additive X thus fed out is sprinkled over the inner peripheral surface of the mask ring 26 by virtue of a free falling thereof, whereby it is adhered to only the first area of the filter material 2 in which area the outer surface of the filter material is exposed to the exterior. In this case, with the compressed air ejected from the air nozzle 45 the additive X can be conducted effectively into the slits 28 of the mask ring 26 and the portion thereof staying on the inner peripheral surface of the mask ring 26 can be surely conducted into the slits 28 by the scraper 44. Consequently, when the filter material 2 is fed out from the mask ring 26, there are formed adhered portions Y of the additive X on the upper surface of the filter material 2 at equal intervals in the moving direction of the filter material and at a uniform thickness, as shown in FIGS. 6 and 7. Since air is sucked through the porous conveyor belt 23 by the air suction member 46, the additive X adhered to the upper surface of the filter material 2 is held in place securely and is prevented from moving on the said upper surface.

Thereafter, the filter material 2 with the additive X adhered thereto is formed into a round rod as previously noted and the wrapping paper 12 is wound round the outer peripheral surface thereof, then the rod-like filter material is cut into a predetermined size.

Figure 8:
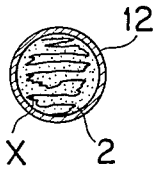
Figure 9:
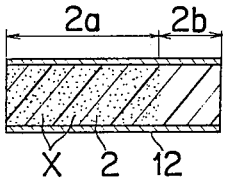

On the upper surface of the filter material 2 are formed the adhered portions Y of the additive X at equal intervals in the moving direction of the filter material as previously described, so in the subsequent rounding of the belt-like filter material 2 into a round rod, the additive X can be distributed uniformly in the round rod-like filter material 2 as shown in FIGS. 8 and 9. Consequently, the area of contact of the additive X with the tobacco smoke passing through the filter material 2 can be taken large, thus permitting a great improvement in adsorbing and absorbing properties of the additive X.

Moreover, when the filter material 2 is formed into a round rod, the additive X is held between wrinkles of the filter material, so there is no fear of an accidental movement of the additive X during tobacco transport or smoking. Besides, when cutting the round rod-like filter material 2, the filter material can be clearly partitioned into areas **2*a* which contain the additive X and areas 2*b* which do not contain the additive X, as shown in FIG. 9**, so it is possible to surely prevent the additive from entering the smoker's mouth during smoking.

Further, according to the above embodiment, the feed roller 30 in the additive feeder 29 is rotated in synchronism with the rotation of the mask ring 26, so with increase of the rotational speed of the mask ring 26, the amount of the additive X supplied from the additive feeder 29 becomes larger. Therefore, the additive adhered portions Y formed on the upper surface of the filter material 2 can be rendered almost constant in thickness regardless of the rotational speed of the mask ring 26. As a result, it is possible to increase the tobacco filter manufacturing speed so that it is suitable for a high volume production, and make the quality of tobacco filters produced uniform.

Figure 10:
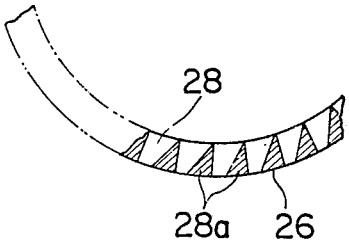
Figure 11:
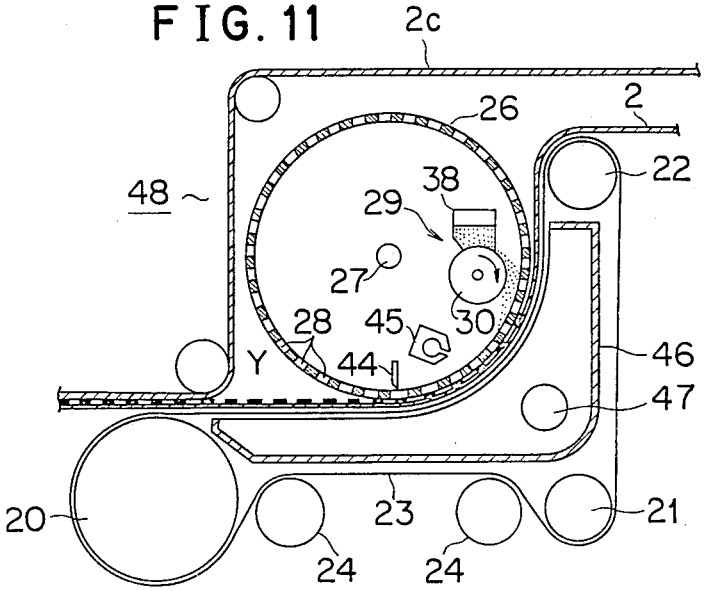

The present invention is not limited to the above embodiment. Modifications of the invention are illustrated in FIGS. 10 and 11. FIG. 10 shows a part of the mask ring 26, in which partition walls **28*a* which define slits 28 are formed triangularly in section such that two neighboring slits adjoin by way of a ridge in an inner surface of the annular structure to prevent the additive X from staying on the inner peripheral surface of the mask ring 26. This structure permits omission of the scrapper 44**.

Referring to FIG. 11, the additive distributing and feeding device 3 is further provided in a synchronized manner with a third conveyance mechanism 48 for conveying an additional belt-like filter material **2*c* separately downstream of the first conveyance machanism 1. The filter material 2*c* is superposed on the upper surface of the filter material 2 with the addtive X adhered thereto, as shown in FIG. 11. By so doing, the movement of the additive X adhered to the filter material 2** can be surely prevented in the following step.

Figure 12:
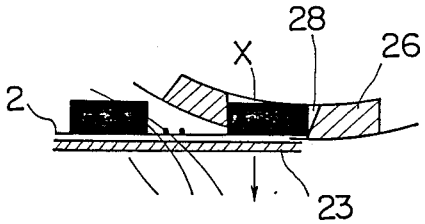
FIG. 12 is an enlarged illustration showing additive adsorbed onto the filter material about to leave the mask ring in the embodiments of FIGS. 1 and 11.

In the foregoing embodiments, the additive X is preferably placed on the filter material 2 in the substantially identical form to the contour of the slits 28. For this purpose, the additive is subjected to suction by way of the highly air permeable porous conveyor belt 23 to cause the additive X to be adsorbed onto the filter material 2. Actually, however, some particles of the additive X can fall onto the areas of the filter material 2 which do not faces the slits 28 of the mask ring 26 but the mask sections thereof between the slits. More specifically, such areas which have so far been covered by the sections of the mask ring 26 to be protected from the suction below are abruptly subjected to said suction when the filter material 2 starts to leave the mask ring 26 with the result that some additive particles are drawn onto such areas as shown in FIG. 12 to be adsorbed and absorved thereto. If such filter material is used, resulting filter rods can have a drawback that the smoking end thereof is absorbed with the additive X. In order to avoid such an unfavorable situation, there are further provided embodiments as shown in FIGS. 13 and 14.

Figure 13:
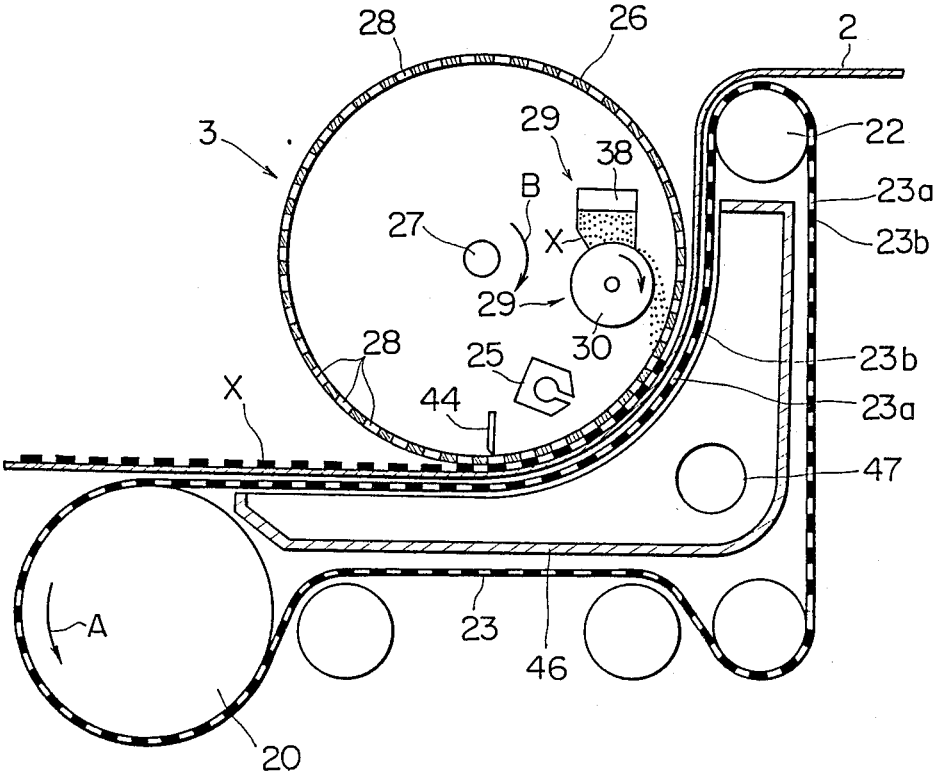
FIG. 13 is a sectional elevation of a further embodiment of the present invention.

Referring to FIG. 13, a band-like filter material 2 is conveyed by an endless conveyor belt 23. Said conveyor belt has an air permeable sections **23*a* and an air nonpermeable sections 23*b*** extending laterally and alternately with respect to the conveying direction. The conveyor may be composed of a belt having air permeable slits or slit-like porous areas. However, it is also permissible to compose said conveyor by providing two lengths of claim conveyors with air non permeable sections extending laterally therebetween in the form of conveyor surface members such that air permeable sections are alternately defined between said conveyor surface members.

In this embodiment, the general structure is substantially the same as the foregoing embodiments except that the filter material 2 is held between the conveyor belt 23 and the mask ring 26 such that the air permeable sections 23*a* of the conveyor belt 23 are in registry with the slits 28 of the mask ring 26. It is also essential that the configurations of the air permeable sections 23*a* of the conveyor 23 and the slits 28 of the masking 26 are substantially indentical and that the rotational speed of the mask ring 26 and the conveying speed of the conveyor belt 23 are synchronized. The internal structure of the mask ring 26 including the additive feeder 29 and the structure of the air suction pipe 47 within the endless conveyor device 23 are substantially the same as those of the foregoing embodiments. In the embodiment of FIG. 13, the additive X supplied onto the filter material 2 has the same configurations as that of the slits 28 in the mask ring while said additive is further subjected to suction through the air permeable section 23*a* which is arranged in registry with the slits 26 of the mask ring 26. Since the second areas which are not supplied with additive X are also in registry with the air non-permeable sections of the conveyor belt 23, the additive supplied will not be subjected to suction from below with the result that the situation as described with reference to FIG. 12 is avoided.

Figure 14:
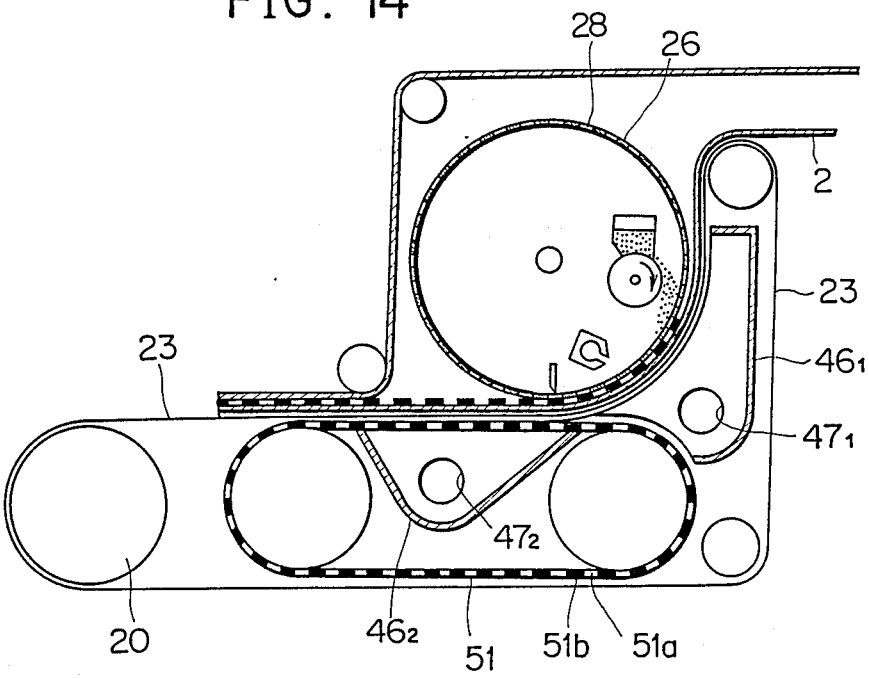
FIG. 14 is a sectional elevation of a still further embodiment of the present invention.

Referring to FIG. 14, there is provided a still further embodiment of the invention, in which the structure of the mask ring 26 is substantially the same as the foregoing embodiments while the structure of the conveying system is different. In this embodiment, the filter material 2 is held between the mask ring 26 and the endless conveyor system which uses an endless belt 23 made of air permeable structure along the entire length. Beneath said endless conveyor belt 23, there is further provided another conveyor system having an endless conveyor belt 51 which extends from beneath the mask ring 26 in a downstream direction with respect to the mask ring rotation. Said endless belt 51 has alternately extending lateral air permeable sections 51*a* and lateral air non-permeable sections 51*b*. Said air permeable sections 51*a* of the belt 51 are set in registry with the slits 28 in the mask ring 26. In this positional relationship, the endless belt 23, the endless belt 51 and the mask ring 26 are driven synchronously. With this structure, the additive X which has been sucked by the negative pressure from the suction pipe $47_1$ in the air suction device $46_1$ to be introduced onto the filter material 2 in an arrangement corresponding to the slits 28 of the mask ring 26 is secured thereon even if the filter material 2 leaves the mask ring 26 because the additive masses dispensed on the filter material 2 continue to be sucked by the negative pressure from the suction pipe $47_2$ of the air suction device $46_2$ through air permeable sections 51*a* with remaining portions covered by air non-permeable sections 51*b*. This embodiment has an advantage that the provision of air permeable sections and air non-permeable sections on a belt may be confined to a limited range i.e. Only downstream of the maskl ring 26.

Figure 15:
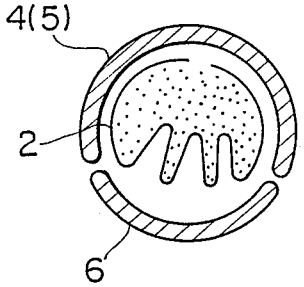
FIGS. 15 and 16 are sectional views of the filter material being squeezed into a rod-shaped article.
Figure 16:
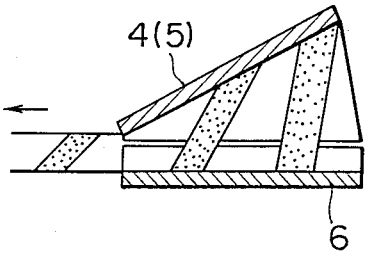

The filter material 2 thus adsorbed with the additive X with neat arrangement is further fed to the first and second forming devices 4 and 5 to be shaped into a rod-like configurations. Said first and second forming devices are of the same structure as the foregoing embodiment. To wit, the first forming device 4 and second forming device 5 are both tubular members which are in the shape of a funnel. The belt-like filter material 2 is formed into a round rod while passing through these devices. While passing through the first or second forming device 4 or 5, the filter material is subject to a feeding force provided by the second transporting device 6. More specifically, the filter material 2 is constricted in a shape as shown in section in FIG. 15, in which it is seen that both lateral ends of the filter material 2 are rolled upward while the center line portion thereof is maintained below said rolled-up lateral ends to face the second transport device 6 such that the filter material 2 is wrinkled and squeezed into a small diameter rod like member. During this process, only the center line portion of the filter material is subject to the driving force to be led forwardly while said lateral ends thereof are apt to lag as shown in FIG. 16 due to the resistance provided by the first or second forming device 4 or 5.

Figure 17:
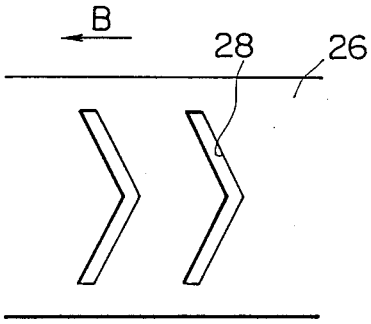
FIG. 17 is an enlarged plan view of the mask ring.
Figure 18:
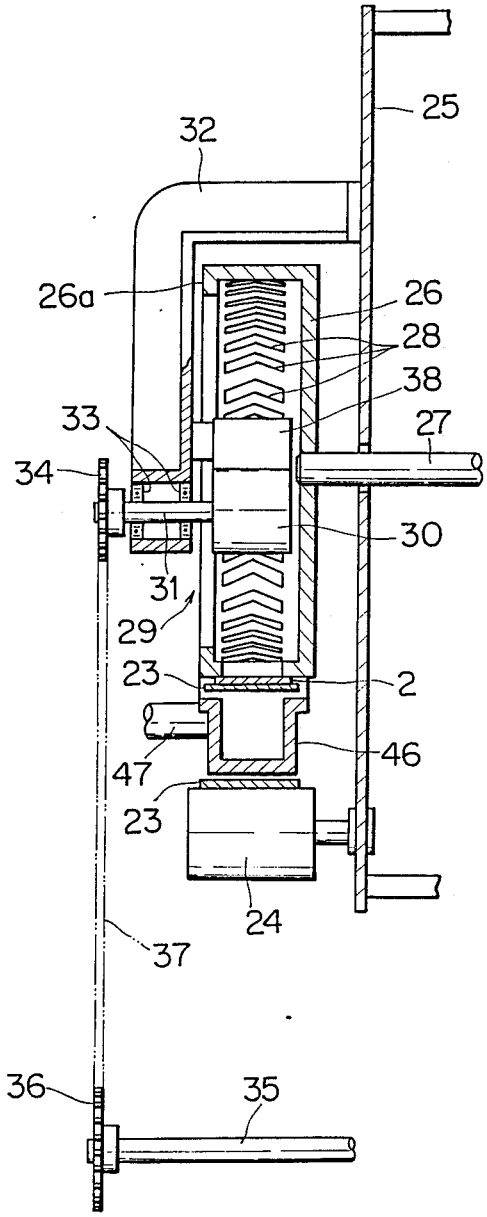
FIG. 18 is an elevation of the general structure of the mask ring in association with the frame of the apparatus.

Referring to FIGS. 17 and 18 , a further embodiment which has substantially the same structure as the embodiments of FIG. 13 or FIG. 14 except the configuration of the slits 28 in the mask ring 26. To wit, each slit 28 has lateral end portions extending forwardly with respect to the feed direction as indicated by an arrow mask B and a center line portion lagging behind said lateral end portions. With this structure, since the additive X supplied onto the filter material 2 in the corresponding pattern will be fed faster at its center line portion than at its lateral end portion while passing through the first or second forming device 4 or 5, the center line portions catch up with the lateral end portions to compensate for the feed lag seen at first and second forming device 4 and 5 with the result that the additive X is supplied onto the filter material in laterally extending spaced apart straight streaks.

Further, though not shown, in place of the mask ring 26 there may be used a mask belt which is driven in synchronism with the conveyor belt 23 and which has slits 28, and in place of the additive feeder 29 using the feed roller 30 there may be used an additive feeder which utilizes vibrations of a vibration plate to supply the additive X from the feed hopper 38.

In the apparatus for manufacturing tobacco filters according to the present invention, the additive supplied onto the filter material will not be scattered in the longitudinal direction but in laterally well aligned relationship even after passing through forming operations, thus producing a high quality filter rods added with a granular additive.

What is claimed is:

1. A tobacco filter manufacturing apparatus comprising air permeable conveyor means for conveying a length of belt-like tobacco filter material longitudinally in a predetermined direction;

a mask member disposed in facing relation to said air permeable conveyor means to hold said length of belt-like tobacco filter material therebetween, said mask member having a plurality of slits therein extending laterally with respect to said length of filter material, each slit in said mask member having an intermediate portion lagging behind opposite lateral ends thereof with respect to said predetermined direction, and a plurality of mask sections between said slits, said air permeable conveyor means having air permeable sections and air non-permeable sections extending laterally and alternately, and extending downstream of said mask member, said air permeable sections of the conveyor means being set in registry with said slits in the mask member, said air non-permeable sections of the conveyor means being set in registry with said mask sections of the mask member, said mask member being movable synchronously together with said air permeable conveyor means in said predetermined direction;

suction means provided on a remote side of the air permeable conveyor means from the filter material; and means for supplying granular additive into said slits such that said granular additive adheres onto the tobacco filter material in laterally extending separate areas thereof through said slits due to suction from said suction means.

2. A tobacco filter manufacturing apparatus according to claim 1, wherein said mask member includes a mask ring having an annular structure rotatable about an axis thereof.

3. A tobacco filter manufacturing apparatus according to claim 2, wherein said granular additive supplying means is disposed within said annular structure.

4. A tobacco filter manufacturing apparatus according to claim 3, wherein said granular additive supplying means includes an additive feed hopper positioned on an upstream side of said axis of the mask ring, a scraper positioned under said axis in contact with the mask ring and an air nozzle positioned between said additive feed hopper and said scraper.

5. A tobacco filter manufacturing apparatus according to claim 4, wherein two neighboring slits are spaced apart from each other in an inner surface of the annular structure.

6. A tobacco filter manufacturing apparatus according to claim 2, wherein said air permeable conveyor means includes an endless belt running along part of a circumference of said mask ring, said air permeable sections and air non-permeable sections of the air permeable conveyor means being in facing relation to said part of the circumference of the mask ring.

7. A tobacco filter manufacturing apparatus according to claim 2, wherein said air permeable conveyor means includes a first endless conveyor belt running along part of a circumference of said mask ring and a second endless conveyor belt extending downstream of the mask ring towards said predetermined direction, said first conveyor belt being of a porous material along an entire length thereof, said second conveyor belt having said air permeable sections and said air non-permeable sections therein.

* * * * *